US012492878B2

(12) United States Patent
Fernandez

(10) Patent No.: US 12,492,878 B2
(45) Date of Patent: Dec. 9, 2025

(54) RECESSED EXPANSION CHAMBER IN A GUN SLIDE CONFIGURED FOR IMPROVING RECOIL MITIGATION IN FIREARMS

(71) Applicant: William Fernandez, Concord, NC (US)

(72) Inventor: William Fernandez, Concord, NC (US)

(73) Assignee: FDEZ WERX, LLC., Concord, NC (US)

( * ) Notice: Subject to any disclaimer, the term of this patent is extended or adjusted under 35 U.S.C. 154(b) by 0 days.

(21) Appl. No.: 18/601,351

(22) Filed: Mar. 11, 2024

(65) Prior Publication Data

US 2024/0302118 A1 Sep. 12, 2024

Related U.S. Application Data

(60) Provisional application No. 63/489,647, filed on Mar. 10, 2023.

(51) Int. Cl.
*F41A 21/36* (2006.01)
*F41A 5/02* (2006.01)

(52) U.S. Cl.
CPC ..... *F41A 21/36* (2013.01); *F41A 5/02* (2013.01)

(58) Field of Classification Search
CPC .... F41A 21/36; F41A 3/90; F41A 5/02; F41A 21/34; F41A 21/30; F41A 5/20
See application file for complete search history.

(56) References Cited

U.S. PATENT DOCUMENTS

| | | | | | |
|---|---|---|---|---|---|
| 2,581,395 | A * | 1/1952 | Elfstrom | F41A 5/20 | 89/14.3 |
| 4,691,614 | A * | 9/1987 | Leffel | F41A 21/36 | 89/14.3 |
| 5,020,416 | A * | 6/1991 | Tripp | F41A 21/38 | 89/14.3 |
| 5,076,137 | A * | 12/1991 | Paredes | F41A 21/36 | 89/14.3 |
| 5,305,678 | A * | 4/1994 | Talbot | F41A 21/36 | 42/1.06 |
| 5,549,030 | A * | 8/1996 | Lespron | F41A 21/36 | 89/14.3 |
| 5,563,362 | A * | 10/1996 | York | F41A 21/36 | 89/14.3 |
| 11,525,648 | B2 * | 12/2022 | Fan | F41A 21/36 | |
| 2018/0058792 | A1 * | 3/2018 | Schirmer | F41A 21/36 | |
| 2024/0011730 | A1 * | 1/2024 | Toner | F41A 21/36 | |

* cited by examiner

*Primary Examiner* — Joshua E Freeman
(74) *Attorney, Agent, or Firm* — Jeffrey C. Watson, Esq.; Grell & Watson Patent Attorneys LLC

(57) ABSTRACT

A recessed expansion chamber in a gun slide is configured for improving recoil mitigation in firearms. The gun slide is for a pistol firearm with a barrel and includes a recessed expansion chamber. The recessed expansion chamber is positioned forward of the barrel end of the barrel. An expansion chamber opening is included through the gun slide in communication with the recessed expansion chamber. The recessed expansion chamber is configured to allow gases leaving the barrel at the barrel end to expand and be directed out of the gun slide through the expansion chamber opening.

13 Claims, 20 Drawing Sheets

RECESSED EXPANSION CHAMBER IN A GUN SLIDE CONFIGURED FOR IMPROVING RECOIL MITIGATION IN FIREARMS

CROSS-REFERENCE TO RELATED APPLICATIONS

This application claims benefit to U.S. Provisional Patent Application No. 63/489,647 filed on Mar. 10, 2023, entitled Recessed Expansion Chamber in a Gun Slide Configured for Improving Recoil Mitigation in Firearms, which is incorporated by reference in its entirety.

FIELD OF THE DISCLOSURE

The present disclosure relates to weaponry, and more particularly, to gun slides for weaponry. More specifically, the present disclosure relates to a recessed expansion chamber in a gun slide configured for improving recoil mitigation in firearms.

BACKGROUND

Generally speaking, a gun slide on most automatic pistols, semi-automatic or fully automatic, is the upper part that reciprocates, or slides, with recoil during the gun's operating cycle. It serves as the bolt carrier group and partly as the receiver, and generally houses the firing pin/striker, the extractor and frequently also the barrel. The gun slide also typically provides a mounting platform for iron and optical sights.

In operation, the slide is moved backwards with each shot by the energy of expanding gases caused by the combusting propellant. Because the slide is spring-loaded, once at the rearmost position, the spring tension will push it back towards the front. Generally, this slide movement cycle serves three functions: the extractor will empty the chamber by pulling out the spent casing from the previous shot, which then gets removed out of the gun by the ejector; the slide inertia will cock the hammer or striker to prepare for the next shot; and the bolt will push a new cartridge from the magazine into the chamber when the slide comes back forward. This action cycle will be repeated for continued firing. On most modern designs, once the magazine is empty, a slide stop will catch and lock the slide at its rearmost position, and will only be released to move back forward after the slide release is depressed. Having the slide automatically loading the chamber and cocking the hammer/striker with each prior shot is essential for the function of double-action and single-action pistols.

Firearm slides in current production, including slides with porting and or integrated compensators, all use barrels that come flush to the muzzle end, or slides that have a straight wall design from the barrel support, past the barrel end, and through to the muzzle end of the slide. These current designs allow for the large majority of the gases leaving the barrel end to flow without restriction out the muzzle end.

One problem that is associated with most semi-automatic or fully automatic pistols is the recoil forces associated with firing the weapon and the movement of the gun slide. Recoil, often called knockback, kickback or simply kick, is the rearward thrust generated when a gun is being discharged. In technical terms, the recoil is a result of conservation of momentum, as the force required to accelerate something will evoke an equal but opposite reactional force, which means the forward momentum gained by the projectile and exhaust gases will be mathematically balanced out by an equal and opposite momentum exerted back upon the gun. For semi-automatic or fully automatic pistols, which are hand held, the shooter's hand and body must dissipate the gun's recoiling momentum over a longer period of time than the bullet travel-time in the barrel, in order not to injure the shooter. Hands, arms and shoulders have considerable strength and elasticity for this purpose, up to certain practical limits. Nevertheless, recoil limits vary from shooter to shooter, depending on body size, the use of recoil padding, individual pain tolerance, the weight of the firearm, and whether recoil buffering systems and muzzle devices are employed. For this reason, establishing recoil safety standards for small arms remains challenging, in spite of the straightforward physics involved. As such, there is clearly a need to mitigate such recoil forces associated with firing such semi-automatic or fully automatic pistols.

The instant disclosure may be designed to address at least certain aspects of the problems or needs discussed above by providing a recessed expansion chamber in a gun slide configured for improving recoil mitigation in firearms.

SUMMARY

The present disclosure may solve the aforementioned limitations of the currently available pistol firearms and gun slides, by providing the disclosed recessed expansion chamber in a gun slide configured for improving recoil mitigation in firearms. The disclosed gun slide may be for a pistol firearm with a barrel. This disclosed gun slide may include a recessed expansion chamber. The recessed expansion chamber may be positioned forward of a barrel end of the barrel. An expansion chamber opening may be included through the gun slide in communication with the recessed expansion chamber. The recessed expansion chamber may be configured to allow gases leaving the barrel at the barrel end to expand and be directed out of the gun slide through the expansion chamber opening.

In select embodiments of the disclosed gun slide with a recessed expansion chamber, the expansion chamber opening may be a singular opening through a side of the gun slide, both sides of the gun slide, a top of the gun slide, or a combination thereof.

In other select embodiments of the disclosed gun slide with a recessed expansion chamber, the expansion chamber opening may be a plurality of openings through a side of the gun slide, both sides of the gun slide, a top of the gun slide, or a combination thereof.

One feature of the disclosed gun slide with a recessed expansion chamber, the recessed expansion chamber may be configured to allow gases leaving the barrel at the barrel end to expand and be directed out of the gun slide through the singular expansion chamber opening or the plurality of openings and out of the gun slide on the side of the gun slide, on both sides of the gun slide, on the top of the gun slide, or a combination thereof.

In select embodiments of the disclosed gun slide with a recessed expansion chamber, the expansion chamber opening may be a slot through the top of the gun slide above the recessed expansion chamber.

In select embodiments of the disclosed gun slide with a recessed expansion chamber, the recessed expansion chamber may include a cylindrical shaped cavity. The cylindrical shaped cavity may be positioned forward of the barrel end. The cylindrical shaped cavity may be sized larger than the barrel. The cylindrical shaped cavity being positioned forward of the barrel end and sized larger than the barrel end may be configured for gases to immediately expand after exiting the barrel end of the barrel. In select embodiments, the cylindrical shaped cavity may be positioned in a body of the gun slide forward of a barrel support.

One feature of the disclosed gun slide with a recessed expansion chamber may be that the recessed expansion chamber may extend an extension distance from the barrel end to a muzzle end. In select embodiments, the extension distance may be at least 0.1 inches from the barrel end to the muzzle end. In select possibly preferred embodiments, the extension distance may be at least 0.23 inches from the barrel end to the muzzle end.

One feature of the disclosed gun slide with a recessed expansion chamber may be that the recessed expansion chamber may be recessed from a main barrel support a recessed depth. In select embodiments, the recessed depth may be at least 0.01 inches from the main barrel support. In select possibly preferred embodiments, the recessed depth may be at least 0.04 inches from the main barrel support.

One feature of the disclosed gun slide with a recessed expansion chamber may be that the recessed expansion chamber may include a width wider than a muzzle opening. In select embodiments, the width of the recessed expansion chamber may be at least 0.1 inches wider than the muzzle opening. In select possibly preferred embodiments, the width of the recessed expansion chamber may be at least 0.32 inches wider than the muzzle opening.

Another feature of the disclosed gun slide with a recessed expansion chamber may be that the recessed expansion chamber may extend an extension distance from the barrel end to a muzzle end, the recessed expansion chamber may be recessed from a main barrel support a recessed depth, and the recessed expansion chamber may include a width wider than a muzzle opening. In select embodiments, the extension distance may be at least 0.1 inches from the barrel end to the muzzle end, the recessed depth may be at least 0.05 inches from the main barrel support, and the width of the recessed expansion chamber may be at least 0.1 inches wider than the muzzle opening. In select possibly preferred embodiments, the extension distance may be at least 0.3 inches from the barrel end to the muzzle end, the recessed depth may be at least 0.08 inches from the main barrel support, and the width of the recessed expansion chamber may be at least 0.32 inches wider than the muzzle opening.

Another feature of the disclosed gun slide with a recessed expansion chamber may be that the recessed expansion chamber may create a splash back wall. The splash back wall may be configured to redirect gases away from a muzzle end opening and out through the expansion chamber openings in the recessed expansion chamber. In select embodiments, the splash back wall may be positioned on the muzzle end opening.

Another feature of the disclosed gun slide with a recessed expansion chamber may be that the recessed expansion chamber may be configured for improving recoil mitigation performance of the pistol firearm. Wherein the recessed expansion chamber may be configured to increase flow of gases out of the gun slide through the expansion chamber openings in the gun slide, where the increased flow of gases out through the expansion chamber openings in the recessed expansion chamber are configured for the improving recoil mitigation performance of the pistol firearm. Wherein the improved recoil mitigation of the pistol firearm may be configured to improve user control, experience and overall performance of the pistol firearm.

In another aspect, the instant disclosure embraces the disclosed gun slide with a recessed expansion chamber in any embodiment and/or combination of embodiments shown and/or described herein.

In another aspect, the instant disclosure embraces a pistol firearm with the disclosed gun slide with a recessed expansion chamber in any embodiment and/or combination of embodiments shown and/or described herein.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

Figure 1:
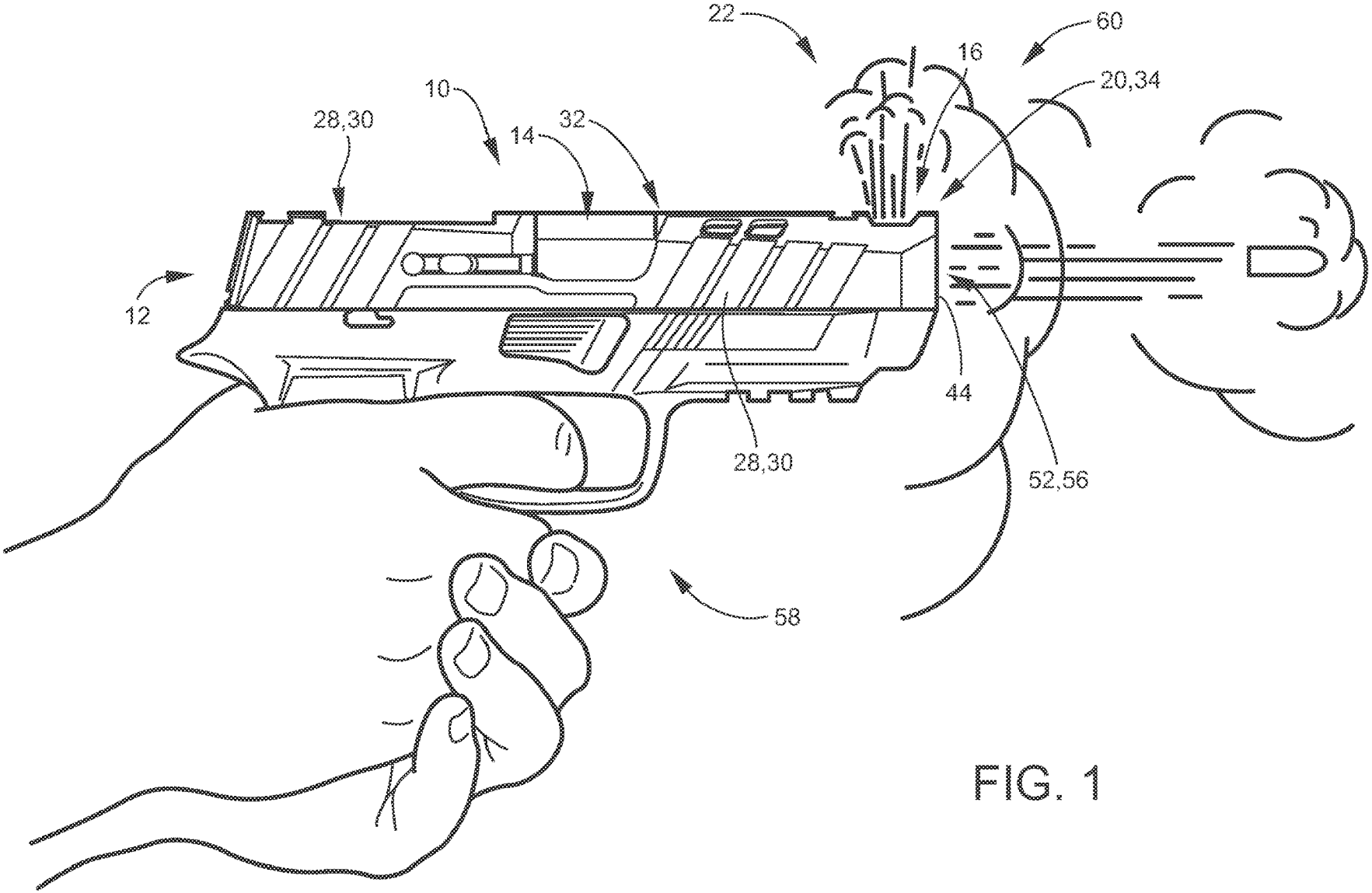
FIG. 1 is a side view of a pistol firearm with the gun slide with the recessed expansion chamber according to select embodiments of the instant disclosure showing the pistol firearm in operation firing a bullet with gases immediately expanding into the recessed expansion chamber and out of the gun slide through expansion chamber openings.
Figure 2:
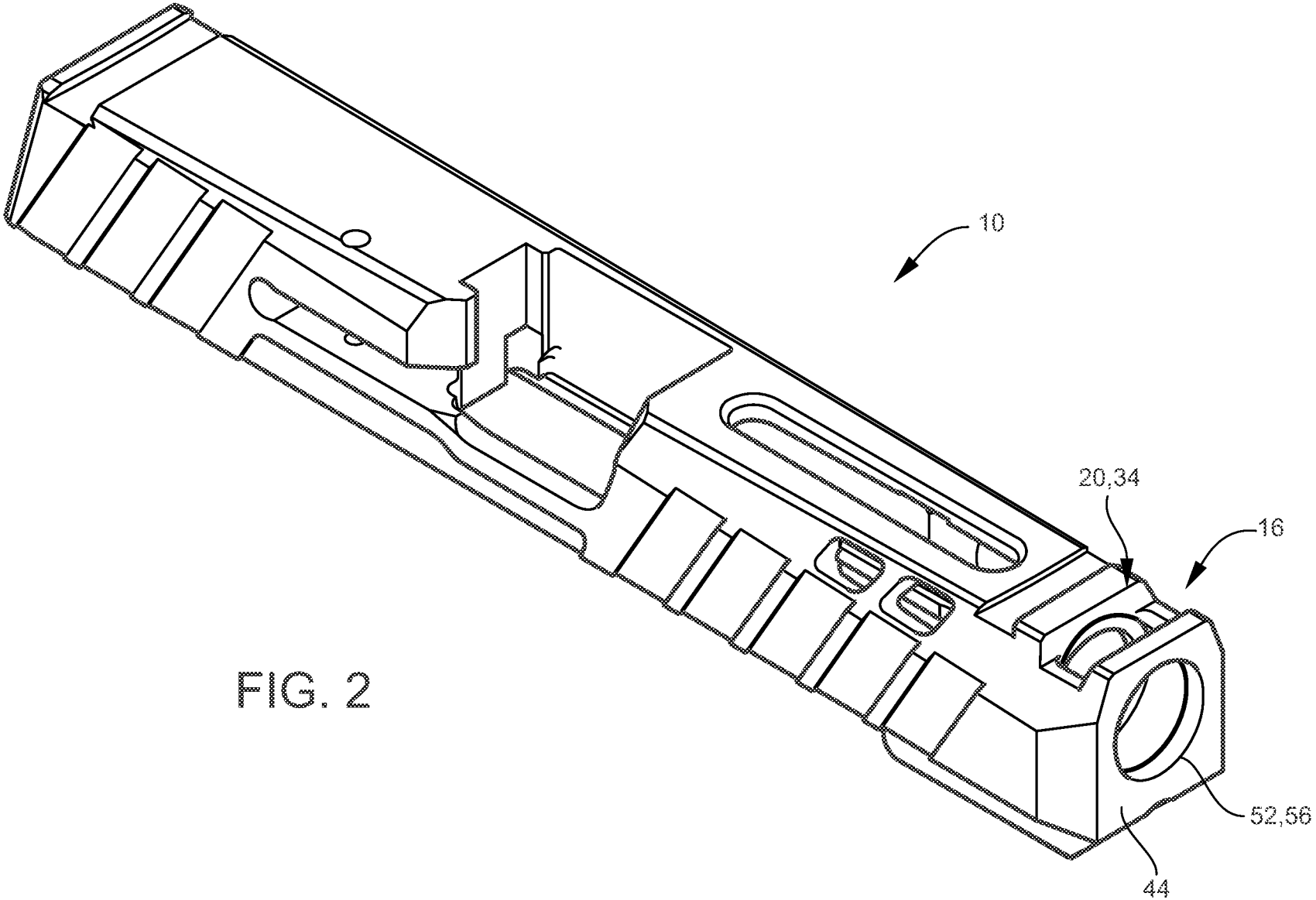
FIG. 2 is a top perspective view of the gun slide with the recessed expansion chamber from FIG. 1.
Figure 3:
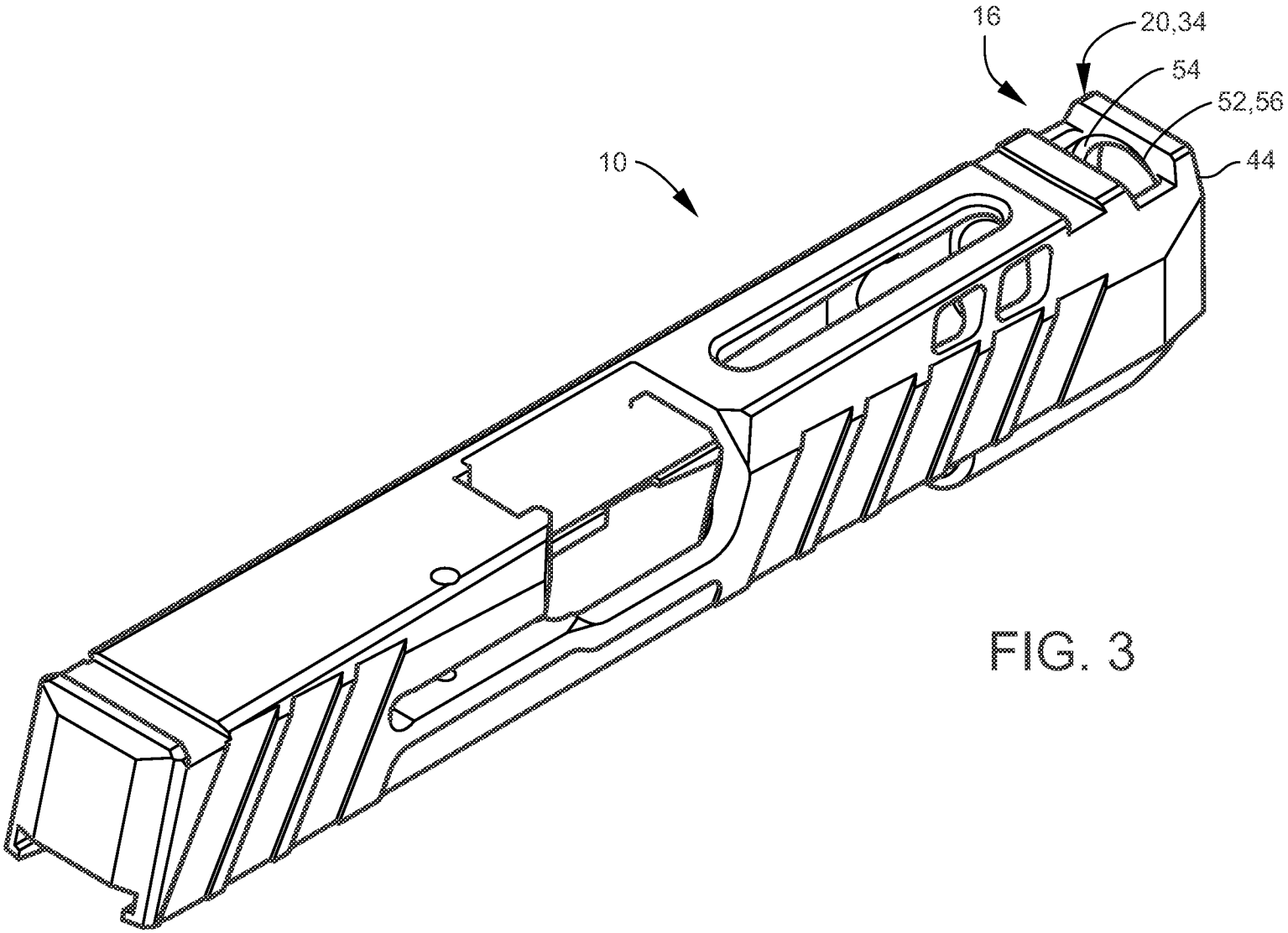
FIG. 3 is another top perspective view of the gun slide with the recessed expansion chamber from FIG. 1.
Figure 4:
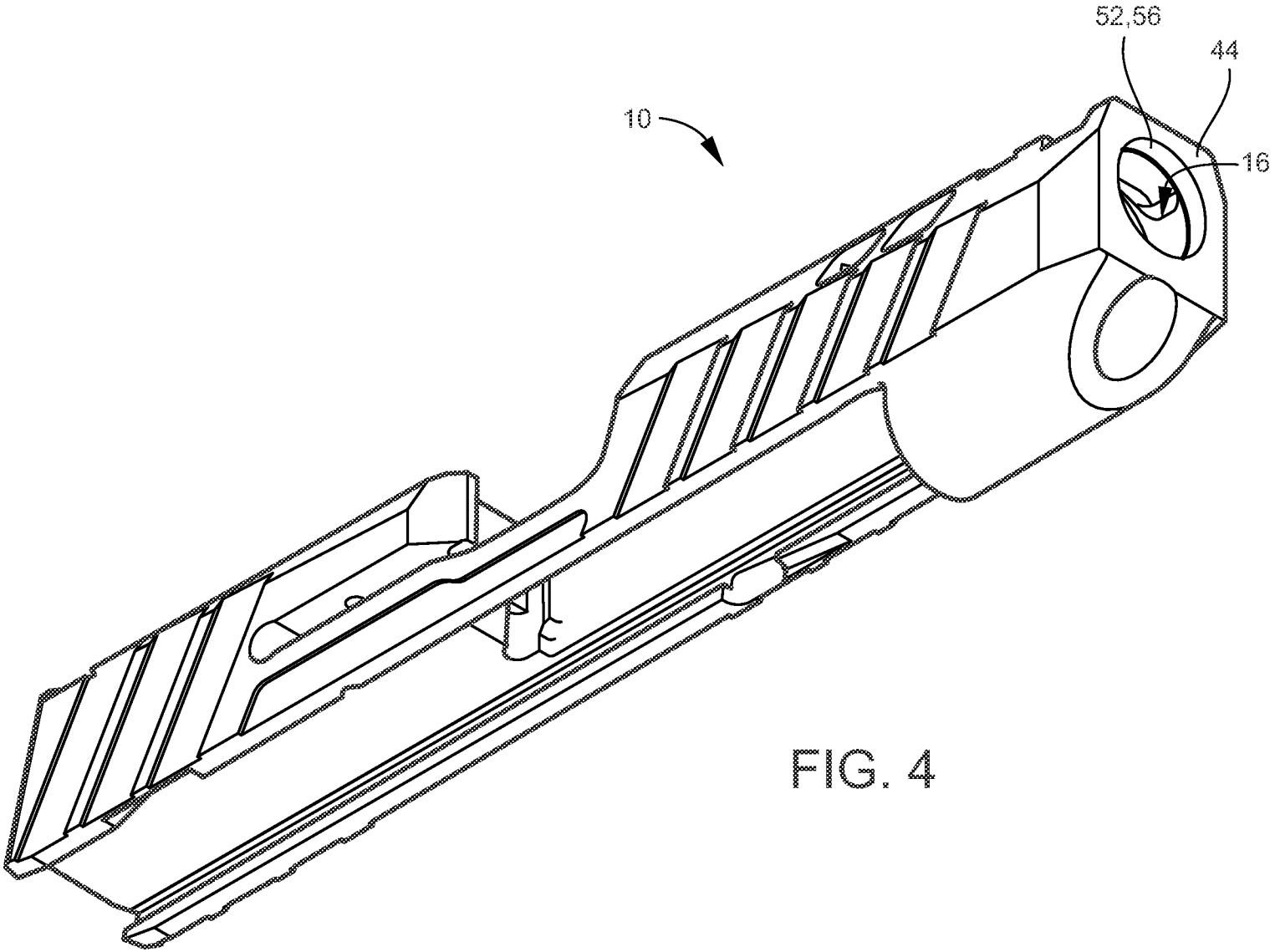
FIG. 4 is a bottom perspective view of the gun slide with the recessed expansion chamber from FIG. 1.
Figure 5:
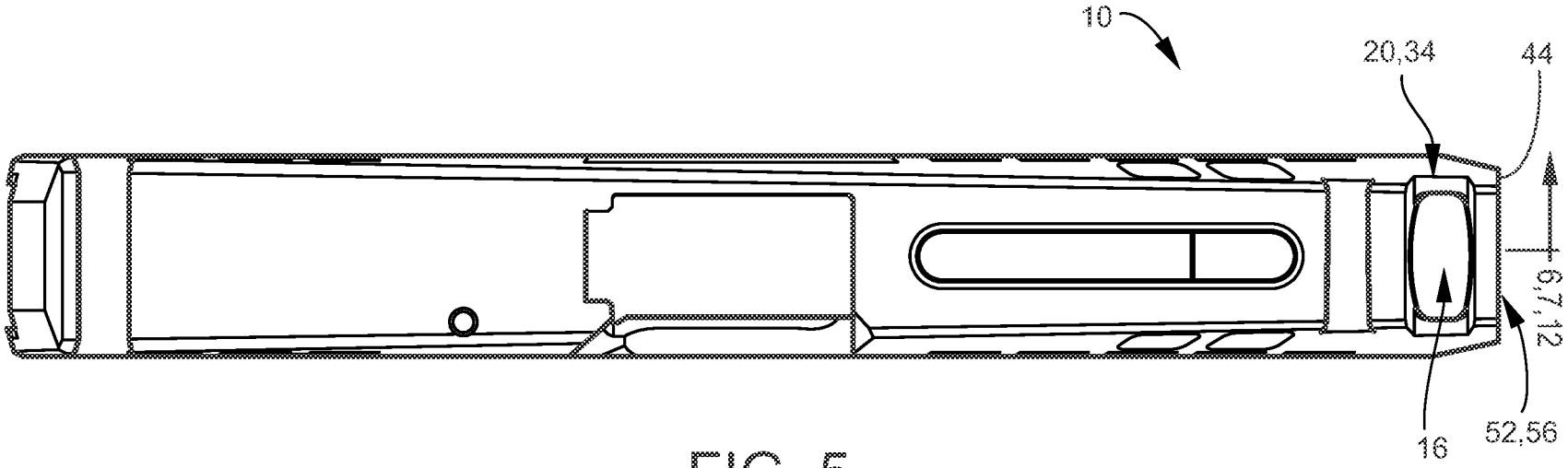
FIG. 5 is a top view of the gun slide with the recessed expansion chamber from FIG. 1.
Figure 6:
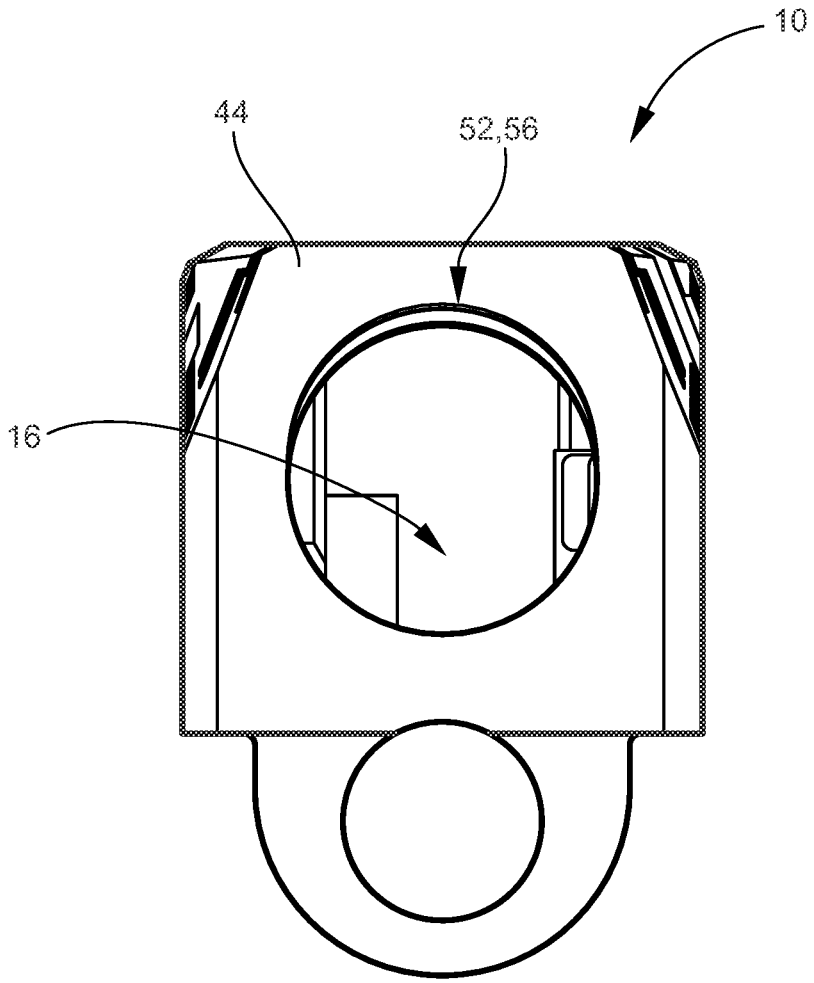
FIG. 6 is a front view of the gun slide with the recessed expansion chamber from FIG. 1.
Figure 7:
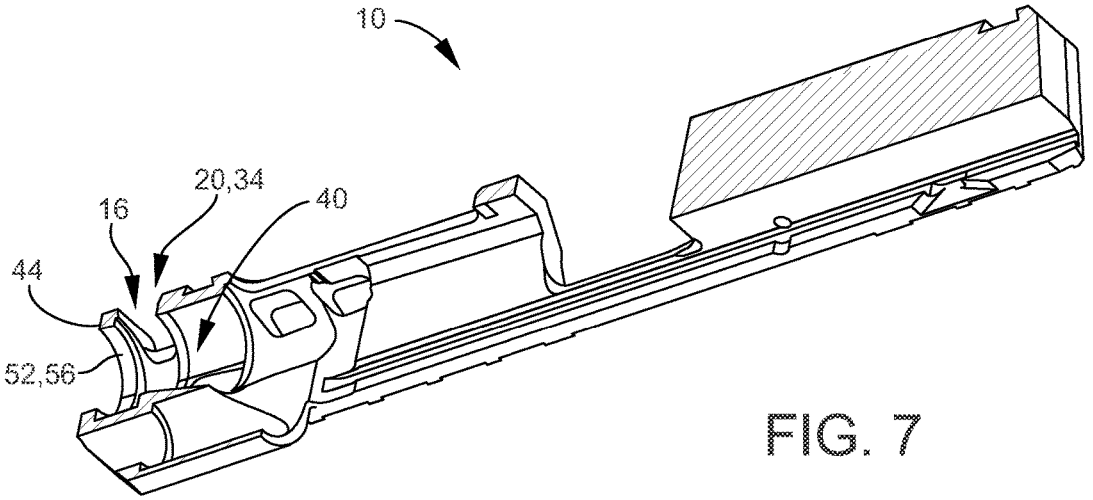
FIG. 7 is a cross-sectional perspective view of the gun slide with the recessed expansion chamber from FIG. 1 from the cross-section indicated in FIG. 4.
Figure 8:
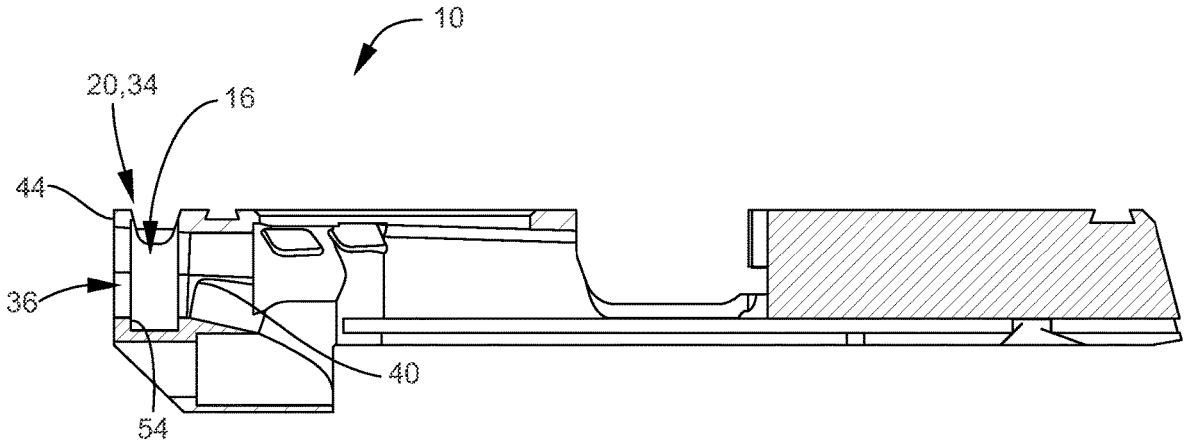
FIG. 8 is a cross-sectional side view of the gun slide with the recessed expansion chamber from FIG. 1 from the cross-sectional indicated in FIG. 4.
Figure 9:
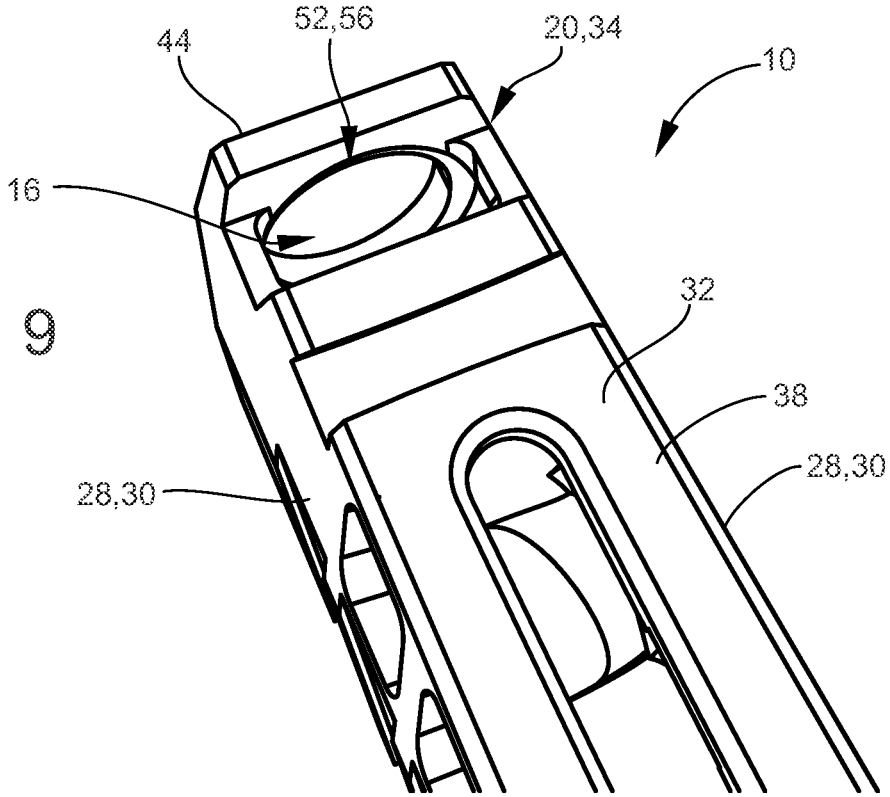
FIG. 9 is a zoomed in top perspective view of the front of the gun slide with the recessed expansion chamber from FIG. 1 showing details of the recessed expansion chamber.
Figure 10:
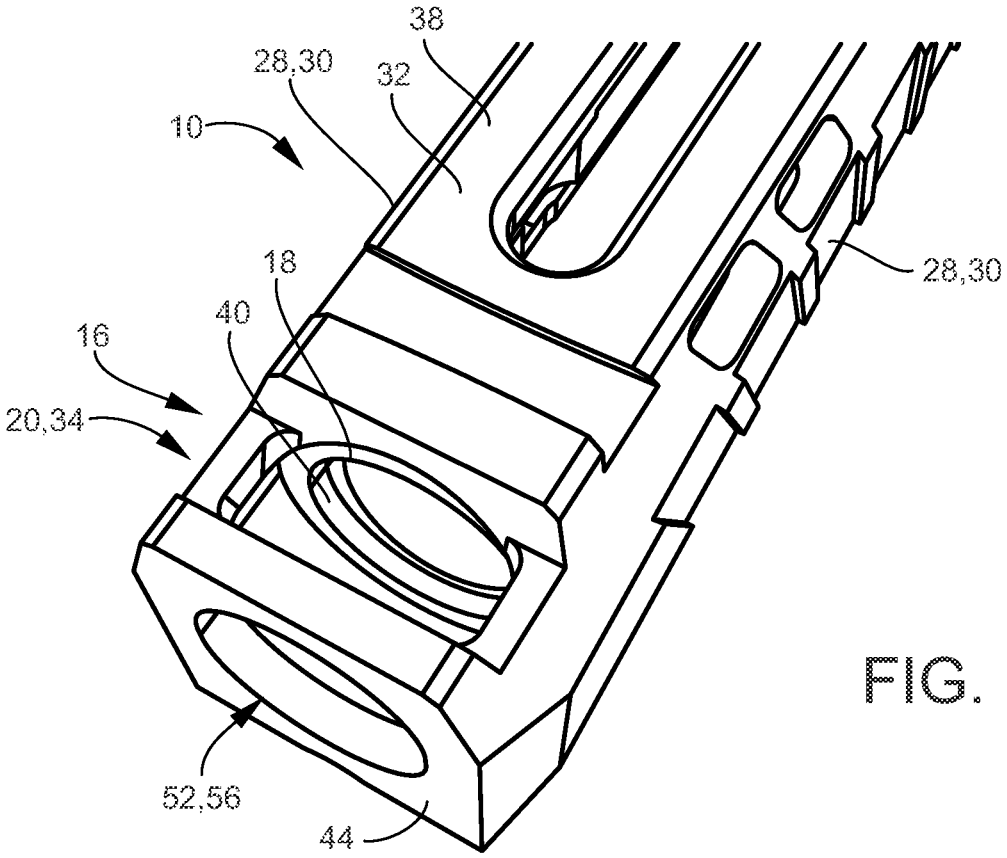
FIG. 10 is another zoomed in top perspective view of the front of the gun slide with the recessed expansion chamber from FIG. 1 showing details of the recessed expansion chamber.
Figure 11:
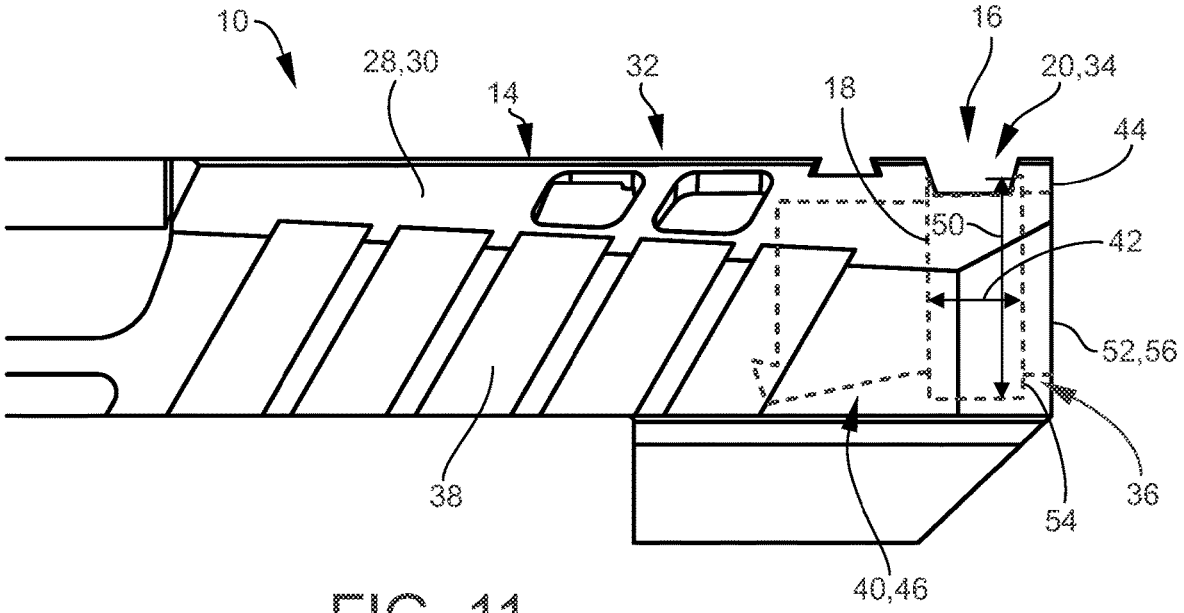
FIG. 11 is a zoomed in side view of the front of the gun slide with the recessed expansion chamber from FIG. 1 showing details of the recessed expansion chamber in dashed lines.
Figure 12:
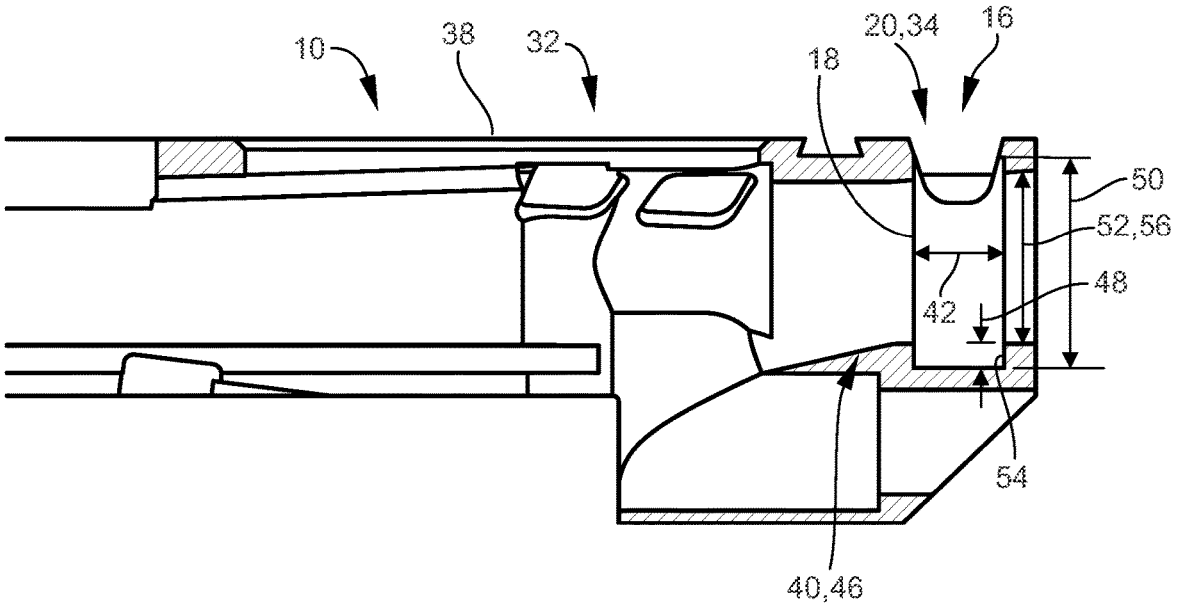
FIG. 12 is a zoomed in cross-sectional side view of the front of the gun slide with the recessed expansion chamber from FIG. 1 showing details of the recessed expansion chamber.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-26, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

Referring to FIGS. 1-26, the present disclosure may solve the aforementioned limitations of the currently available automatic or semi-automatic pistols and gun slides therefore, by providing the disclosed gun slide 10 with a recessed expansion chamber 16. Recessed expansion chamber 16 may be included with the disclosed gun slide 10. Recessed expansion chamber 16 may be configured for improving recoil mitigation performance 58 in such automatic or semi-automatic pistols used thereon. FIGS. 1-13 show one embodiment of gun slide 10 with recessed expansion chamber 16, while FIGS. 14-26 show another embodiment of gun slide 10 with recessed expansion chamber 16.

Referring specifically to FIGS. 1-13, the embodiment of gun slide 10 with recessed expansion chamber 16 shown in FIGS. 1-13 may be intended to be used as a slide for a Sig P365XL pistol (provided by Sig Sauer, Inc. of Newington, NH) but will also fit all P365 FCU's and grip modules. The disclosed gun slide 10 design may be designed and configured to be made from hardened 416 stainless steel material, or the like. The disclosed gun slide 10 design may also be designed and configured to be optic ready with cover and hardware and may include a dedicated rear dovetail, separate from optic mount and cover.

Referring now specifically to FIGS. 14-26, the embodiment of gun slide 10 with recessed expansion chamber 16 shown in FIGS. 14-26 may be intended to be used as a slide for a Sig P365XL pistol. The embodiment shown in FIGS. 14-26 may be designed and configured in an XL length and designed to be used with a P365 length barrel (3.1") and a P365XL recoil spring. The disclosed gun slide 10 design may be designed and configured to be used as a slide to fit all P365 FCUs and grip modules. The disclosed gun slide 10 design may be designed and configured to be made from hardened 416 stainless steel material, or the like. The disclosed gun slide 10 design may also be designed and configured to be optic ready with cover and hardware and may include a dedicated rear dovetail, separate from optic mount and cover.

However, the disclosure is not so limited to the embodiments shown in FIGS. 1-26 designed and configured for the P365XL pistol and gun slide 10 with recessed expansion chamber 16 may be designed and/or configured to fit any gun or pistol with a gun slide, like any automatic or semi-automatic pistol.

Figure 13:
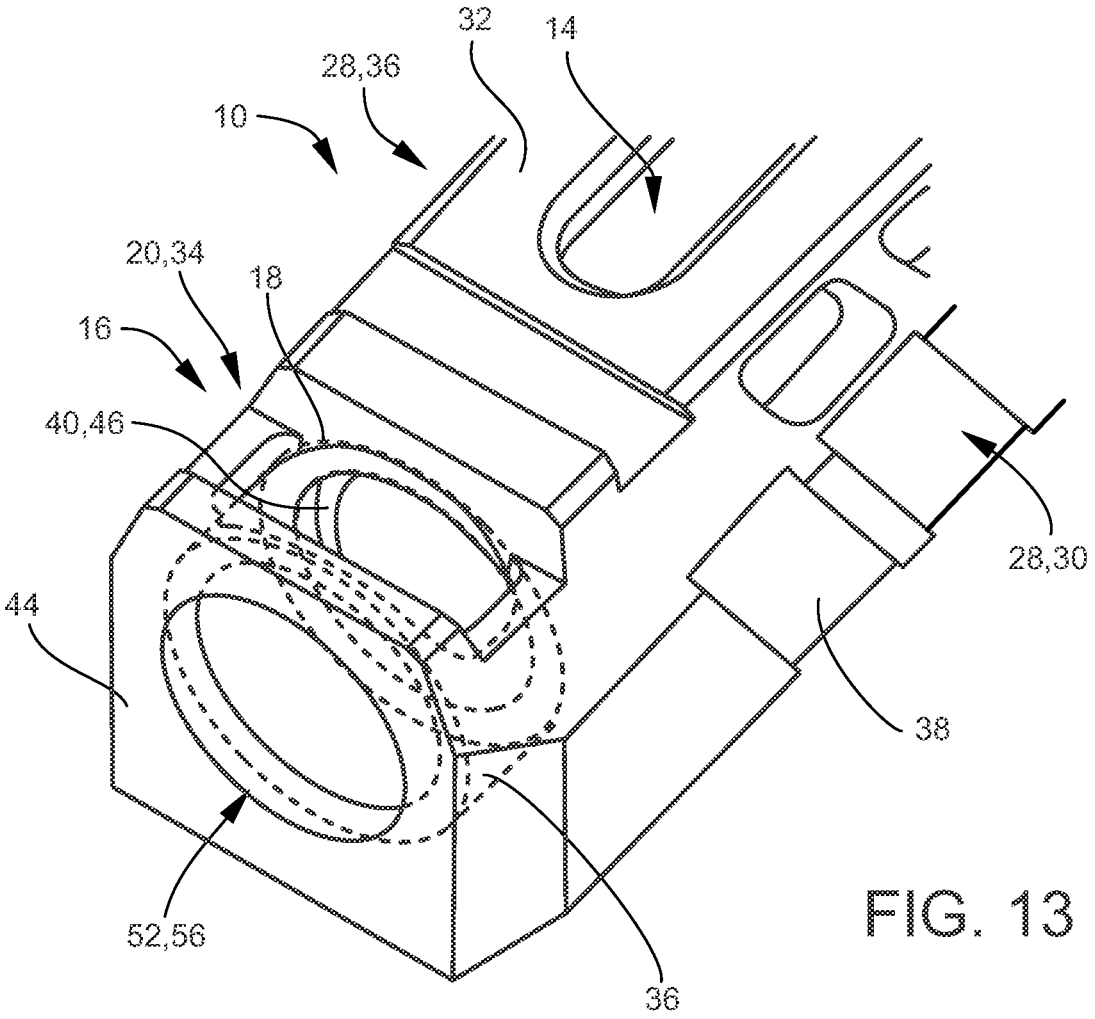
FIG. 13 is a zoomed in top perspective view of the front of the gun slide with the recessed expansion chamber from FIG. 1 showing details of the recessed expansion chamber in dashed lines.
Figure 14:
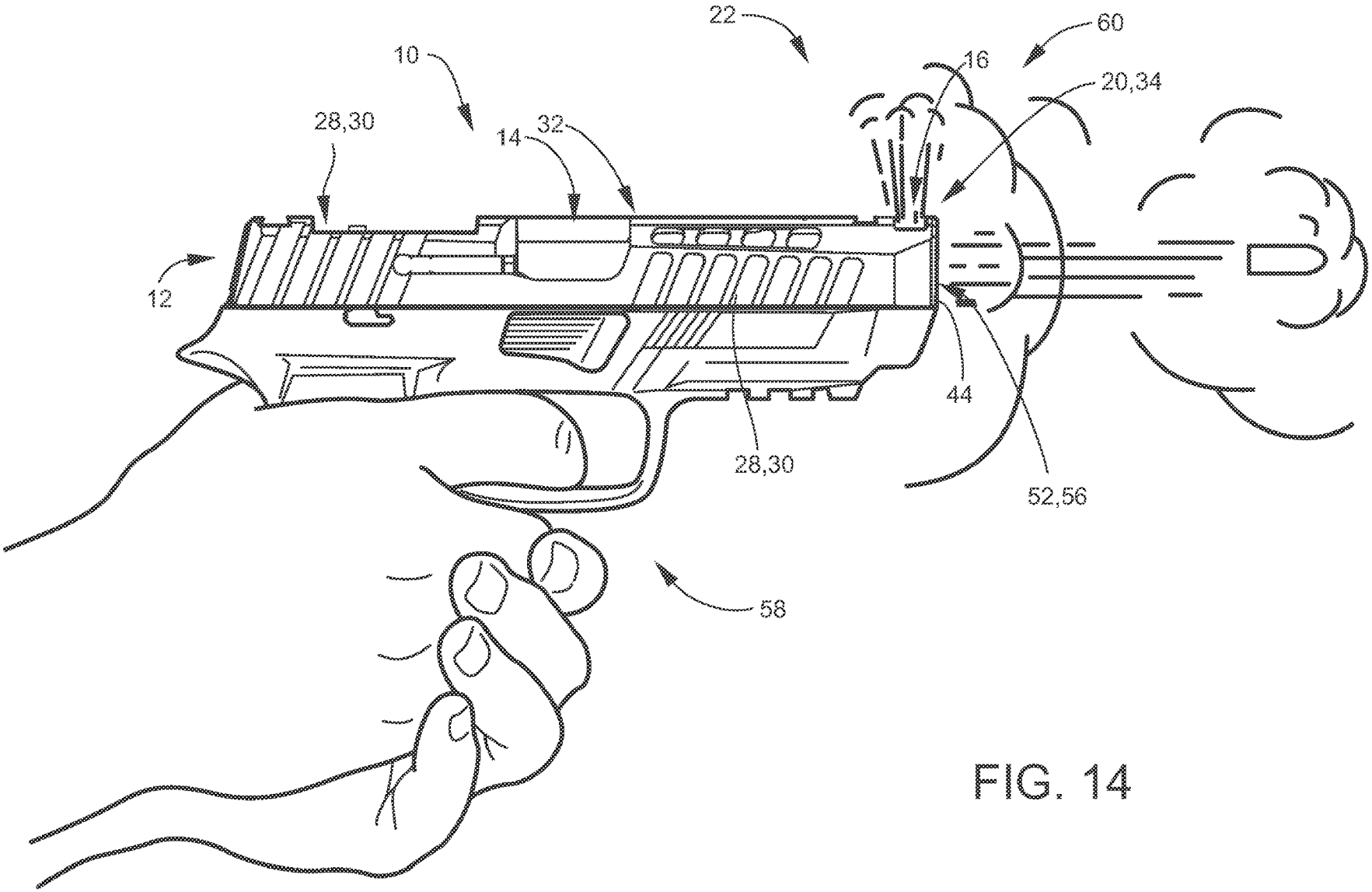
FIG. 14 is a side view of a pistol firearm with the gun slide with the recessed expansion chamber according to select embodiments of the instant disclosure showing the pistol firearm in operation firing a bullet with gases immediately expanding into the recessed expansion chamber and out of the gun slide through the expansion chamber openings.
Figure 15:
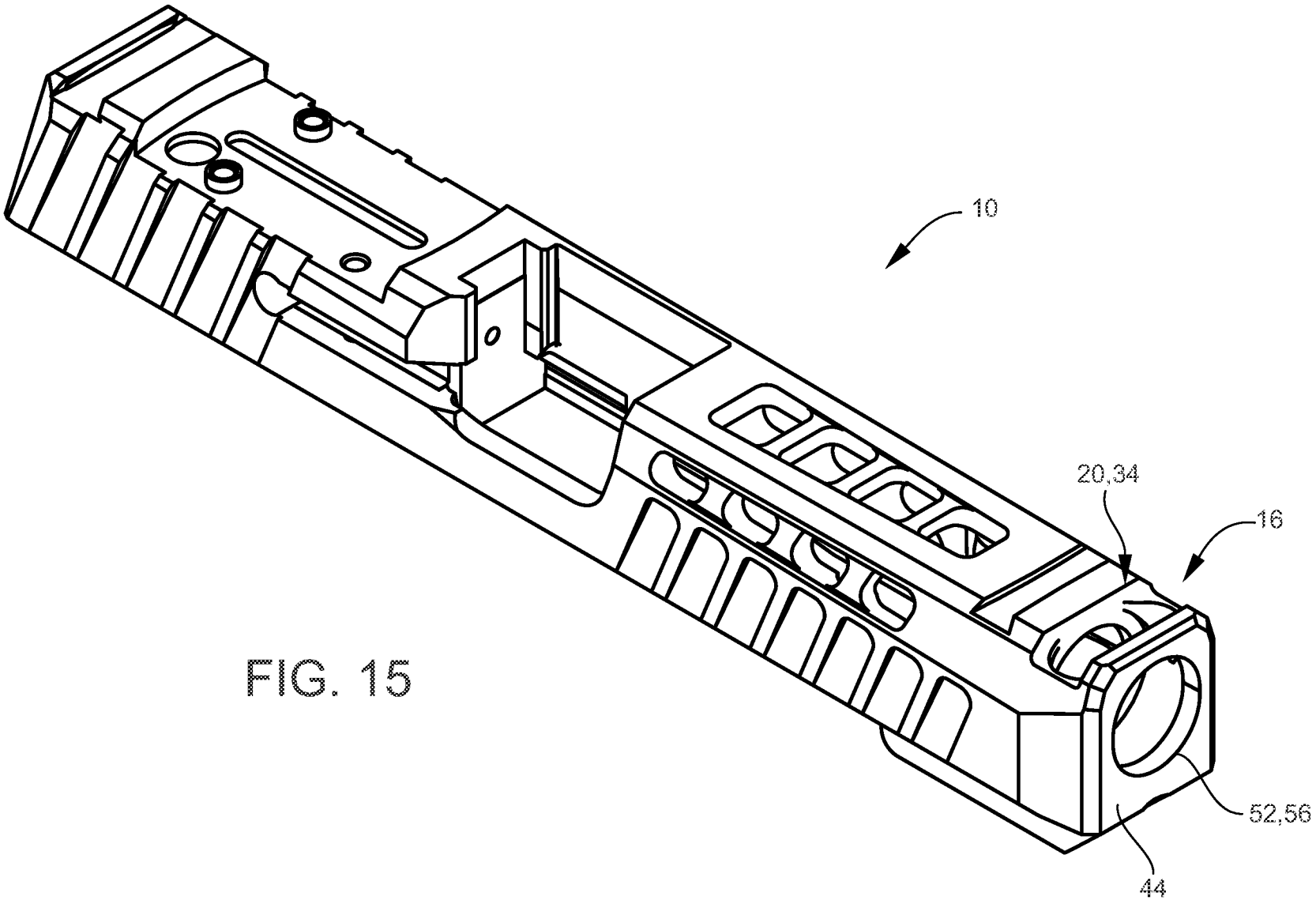
FIG. 15 is a top perspective view of the gun slide with the recessed expansion chamber of FIG. 14.
Figure 16:
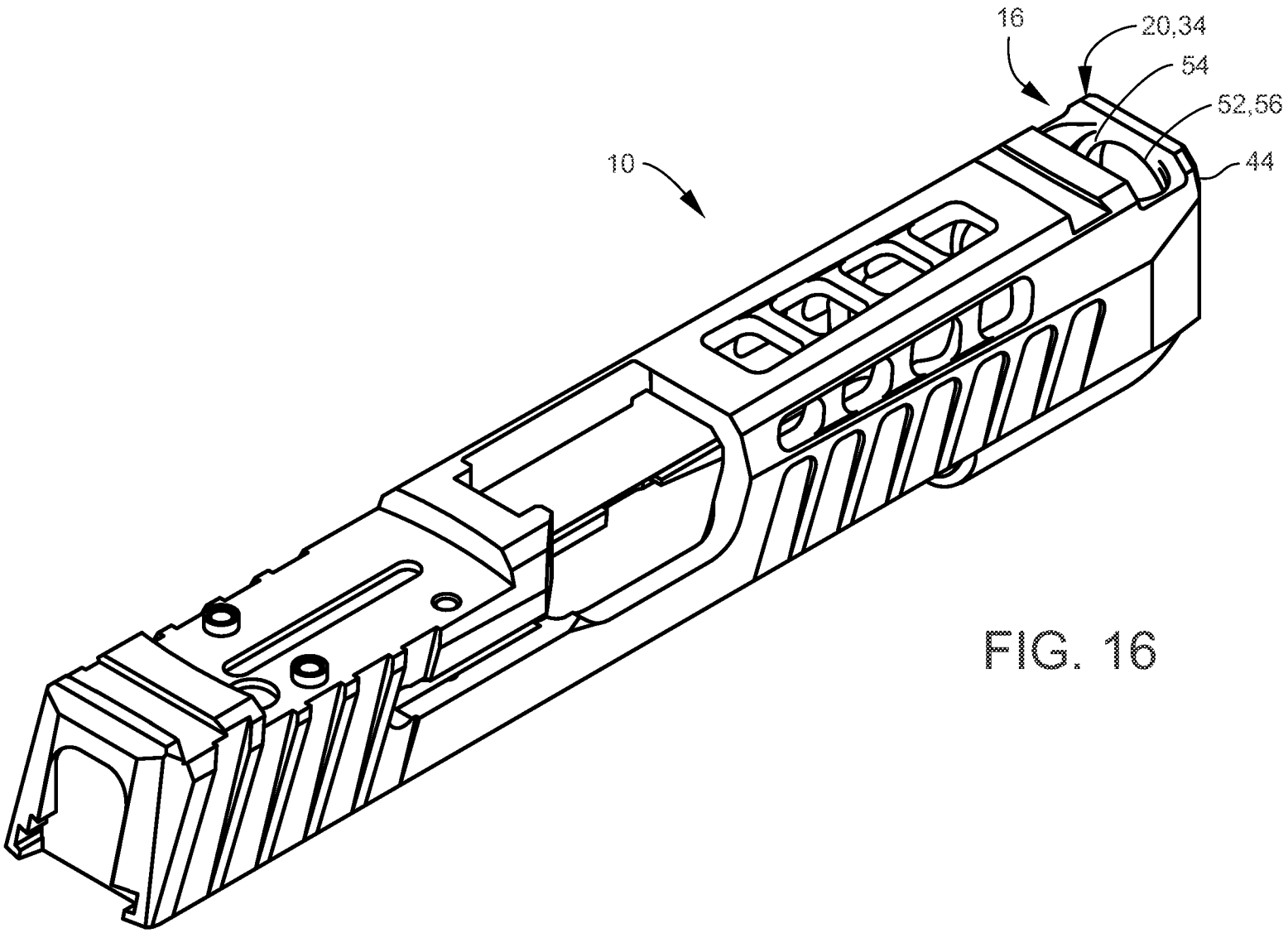
FIG. 16 is another top perspective view of the gun slide with the recessed expansion chamber from FIG. 14.
Figure 17:
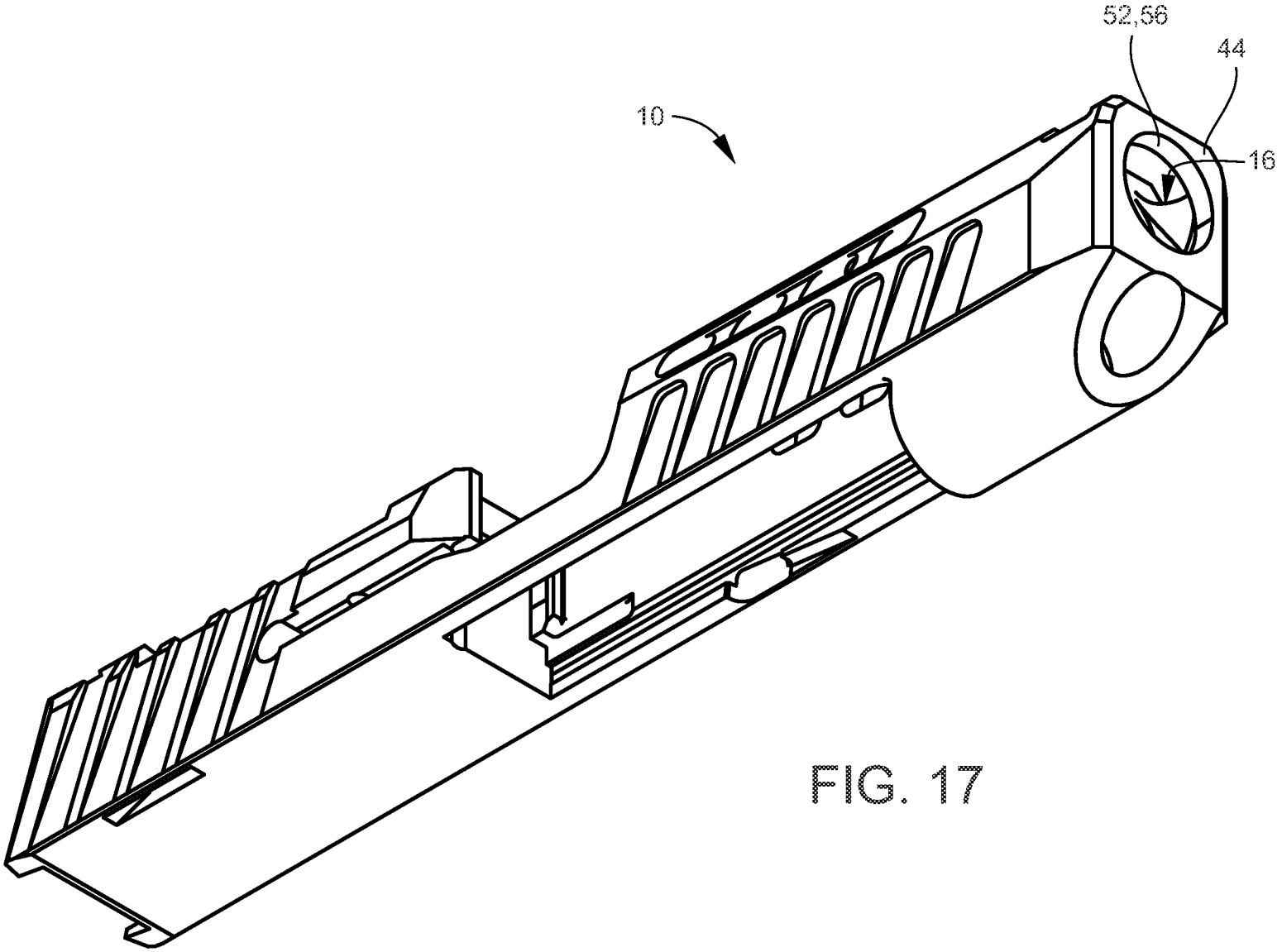
FIG. 17 is a bottom perspective view of the gun slide with the recessed expansion chamber from FIG. 14.
Figure 18:
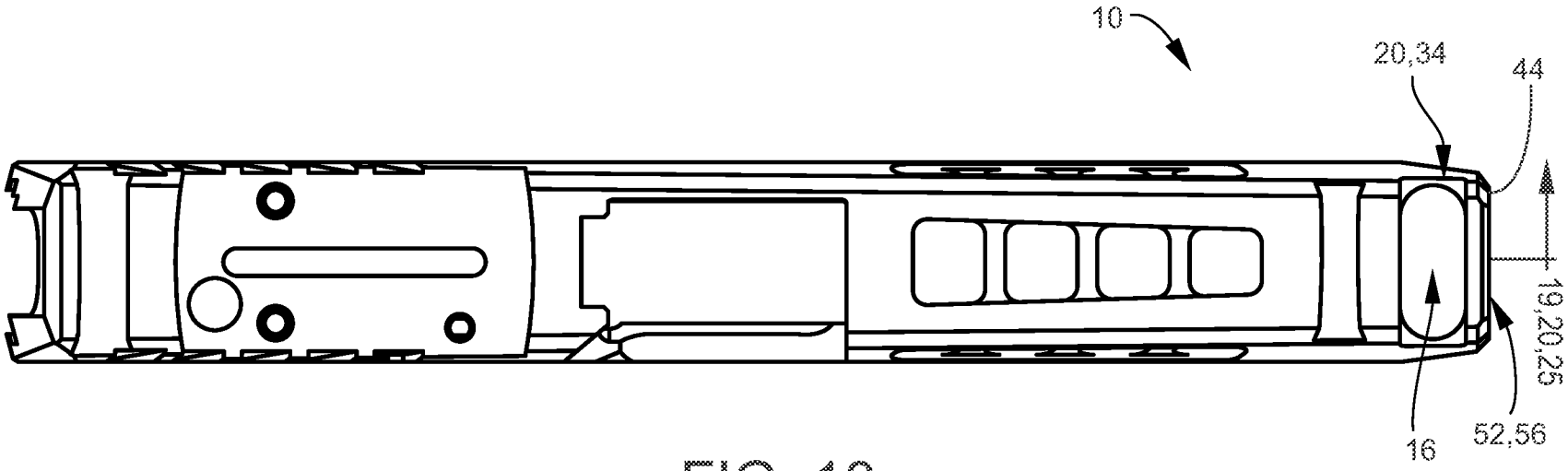
FIG. 18 is a top view of the gun slide with the recessed expansion chamber from FIG. 14.
Figure 19:
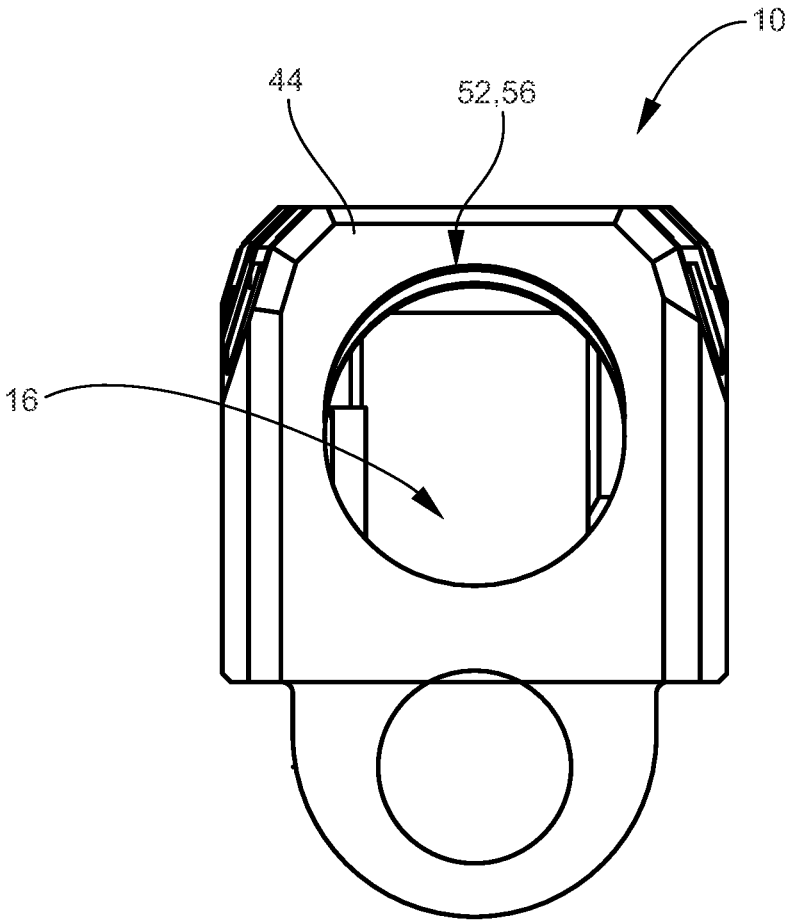
FIG. 19 is a front view of the gun slide with the recessed expansion chamber from FIG. 14.
Figure 20:
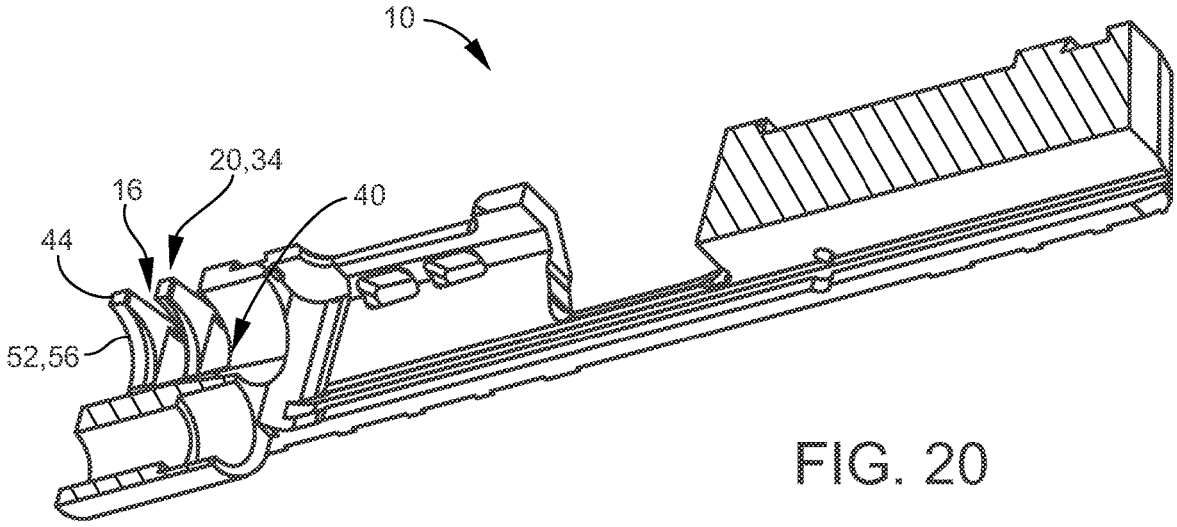
FIG. 20 is a cross-sectional perspective view of the gun slide with the recessed expansion chamber from FIG. 14 from the cross-section indicated in FIG. 17.
Figure 21:
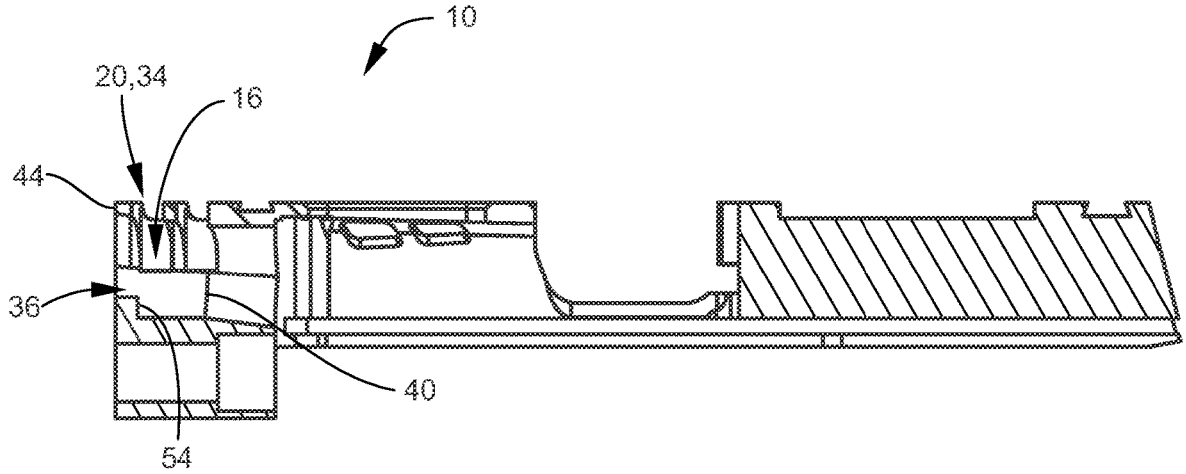
FIG. 21 is a cross-sectional side view of the gun slide with the recessed expansion chamber from FIG. 14 from the cross-sectional indicated in FIG. 17.
Figure 22:
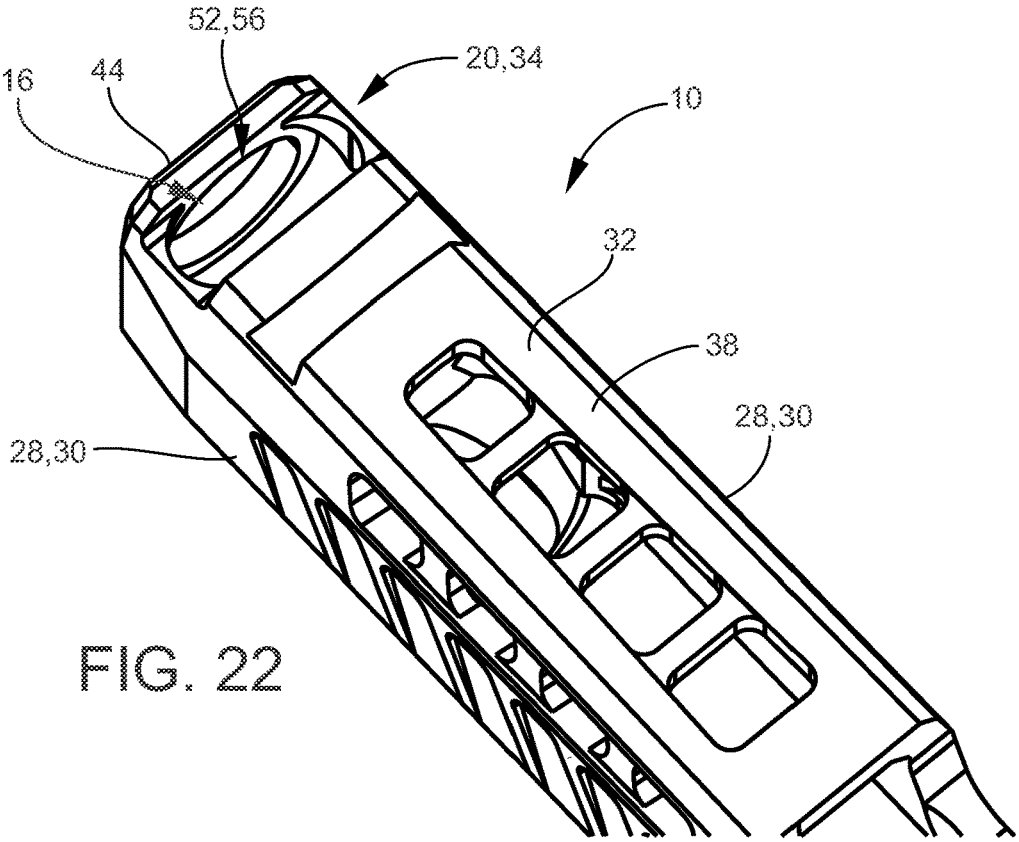
FIG. 22 is a zoomed in top perspective view of the front of the gun slide with the recessed expansion chamber from FIG. 14 showing details of the recessed expansion chamber.
Figure 23:
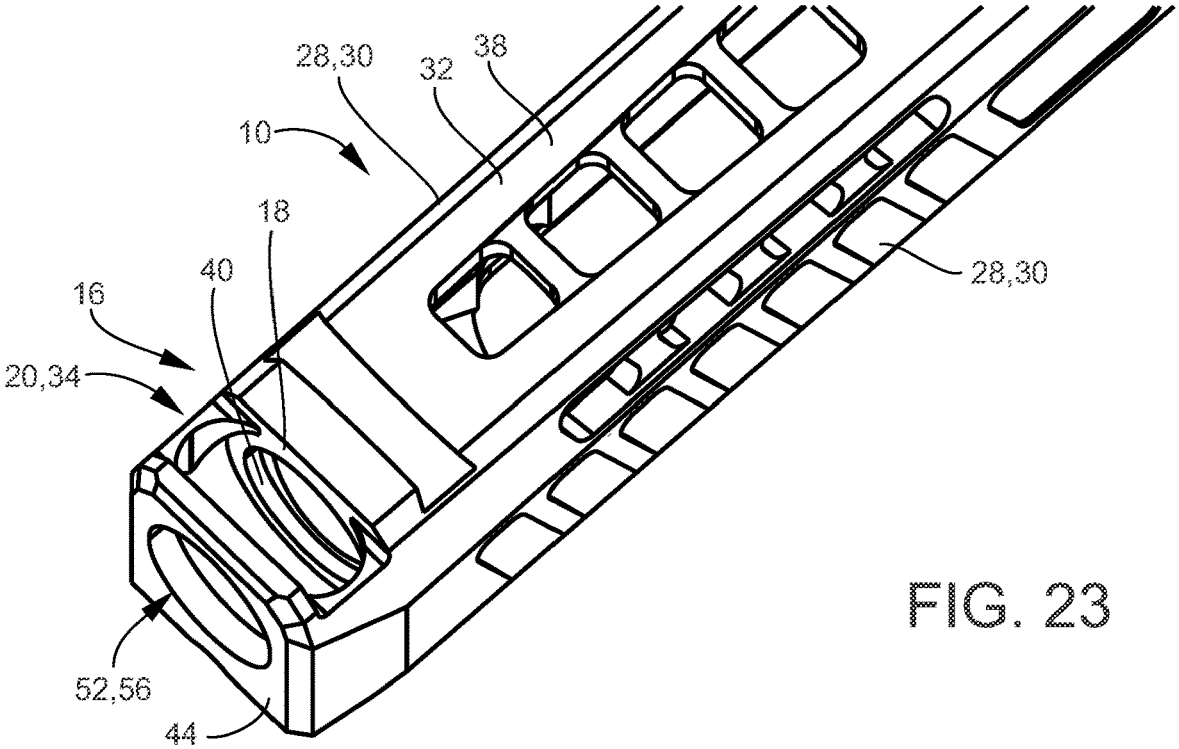
FIG. 23 is another zoomed in top perspective view of the front of the gun slide with the recessed expansion chamber from FIG. 14 showing details of the recessed expansion chamber.
Figure 24:
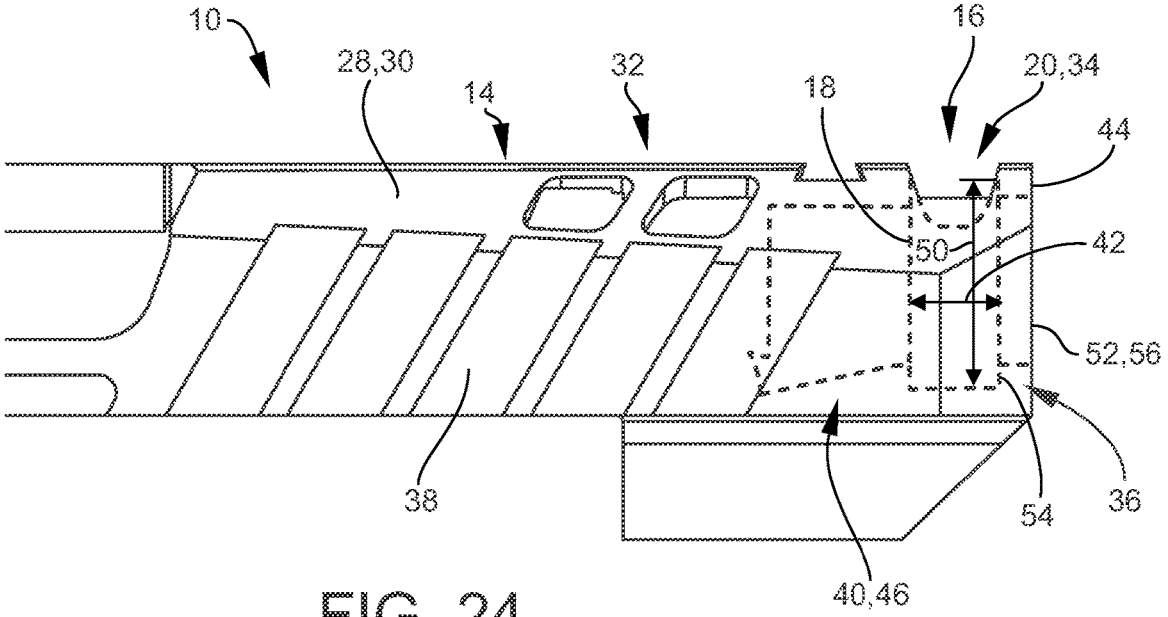
FIG. 24 is a zoomed in side view of the front of the gun slide with the recessed expansion chamber from FIG. 14 showing details of the recessed expansion chamber in dashed lines.
Figure 25:
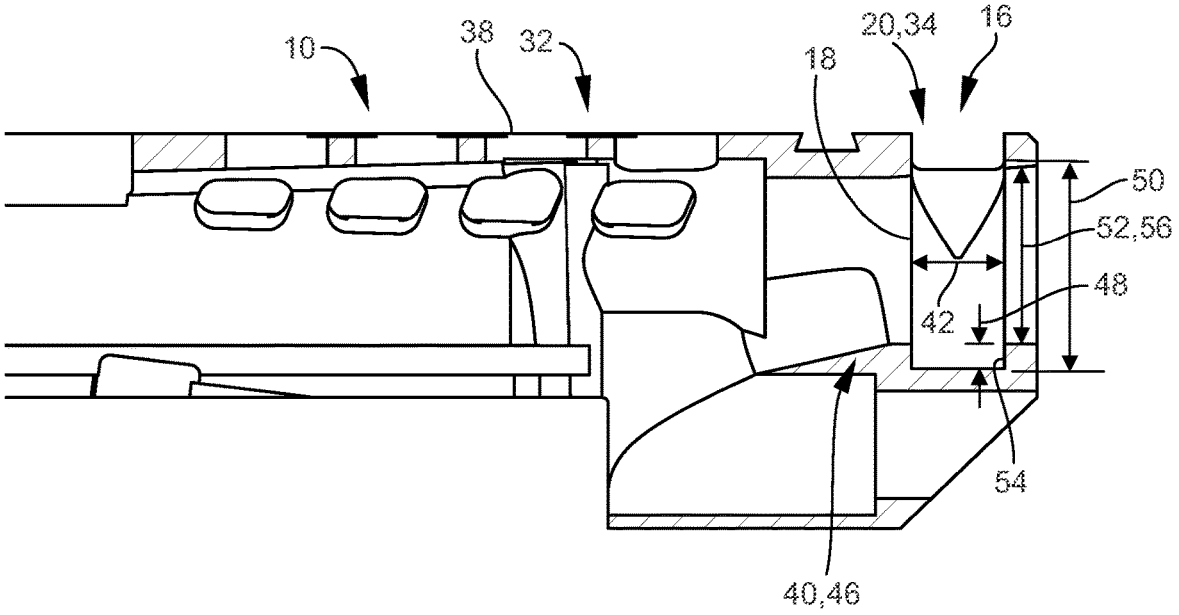
FIG. 25 is a zoomed in cross-sectional side view of the front of the gun slide with the recessed expansion chamber from FIG. 14 showing details of the recessed expansion chamber.

As best shown in FIGS. 1 and 14, recessed expansion chamber 16 may be configured for improving recoil mitigation performance 58 in pistol firearm 12. The disclosed gun slide 10 may be for pistol firearm 12 with barrel 14. This disclosed gun slide 10 may include recessed expansion chamber 16 incorporated therein, like in body 38 of gun slide 10. Recessed expansion chamber 16 may be positioned forward of barrel end 18 of barrel 14 (best shown in FIGS. 10-13 and 23-26). Expansion chamber opening 20 or a plurality of expansion chamber openings 20 may be included through gun slide 10. Each of the expansion chamber openings 20 may be in communication with recessed expansion chamber 16. As a result, recessed expansion chamber 16 may be configured to allow gases 22 leaving barrel 14 at barrel end 18 to expand and be directed through expansion chamber opening 20 or the plurality of expansion chamber openings 20 and out of the gun slide 10. In select embodiments of gun slide 10 with recessed expansion chamber 16, expansion chamber opening 20 may be a singular expansion chamber opening 20 through side 28 of gun slide 10, through both sides 30 of gun slide 10, through top 32 of gun slide 10, or a combination thereof. In other select embodiments of gun slide 10 with recessed expansion chamber 16, expansion chamber opening 20 may be a plurality of expansion chamber openings 20 through side 28 of gun slide 10, through both sides 30 of gun slide 10, through top 32 of gun slide 10, or a combination thereof. Accordingly, one feature of gun slide 10 with recessed expansion chamber 16, may be that recessed expansion chamber 16 may be configured to allow gases 22 leaving barrel 14 at barrel end 18 to expand and be directed through singular expansion chamber opening 20 (or plurality of expansion chamber openings 20) and out of gun slide 10 on side 28 of gun slide 10, on both sides 30 of gun slide 10, on top 32 of gun slide 10, or a combination thereof.

As shown in FIGS. 1 and 14, in select embodiments of gun slide 10 with recessed expansion chamber 16, expansion chamber opening 20 may be slot 34 through top 32 of gun slide 10 above recessed expansion chamber 16. Slot 34 may expand the entire top 32 of gun slide 10 and may be as wide as extension distance 42 of recessed expansion chamber 16. The design and position of slot 34 on the muzzle end 44 of gun slide 10, may provide a counter force to pistol firearm 12 recoiling upwards by flow 60 of gases 22 exiting recessed expansion chamber 16 through slot 34.

Figure 26:
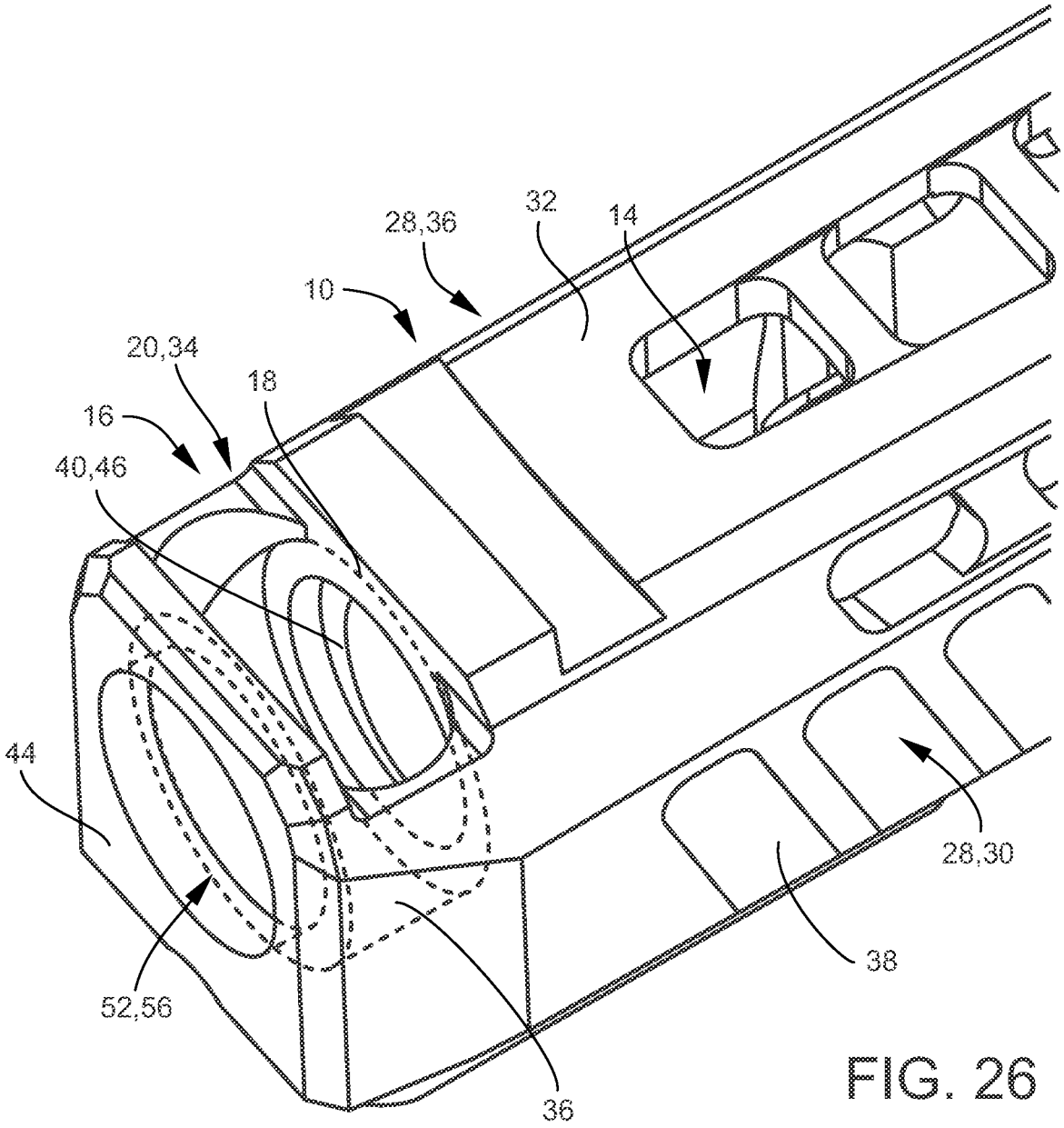
FIG. 26 is a zoomed in top perspective view of the front of the gun slide with the recessed expansion chamber from FIG. 14 showing details of the recessed expansion chamber in dashed lines.

As best shown in FIGS. 13 and 26, in select embodiments of gun slide 10 with recessed expansion chamber 16, recessed expansion chamber 16 may include cylindrical shaped cavity 36. However, the disclosure is not so limited and recessed expansion chamber 16 may include other desired shapes configured for allowing gases to immediately expand after barrel end 18. Cylindrical shaped cavity 36 may be positioned forward of barrel end 18. Cylindrical shaped cavity 36 may be sized larger than barrel 14. This feature may allow for gases 22 to immediately expand after exiting barrel end 18. As a result, cylindrical shaped cavity 36 being positioned forward of barrel end 18 and sized larger than barrel end 18 may be configured for gases 22 to immediately expand after exiting barrel end 18 of barrel 14. In select embodiments, cylindrical shaped cavity 36 may be positioned in body 38 of gun slide 10 forward of barrel support 40. Barrel support 40 may be where barrel 14 would rest. At the end of barrel 14, barrel support 40 would be recessed to create recessed expansion chamber 16. As such, this recessed expansion chamber 16 at barrel end 18 of end of barrel 14 would allow gases to immediately start expanding once they leave barrel 14.

As best shown in FIGS. 11-12 and 24-25, one feature of gun slide 10 with recessed expansion chamber 16 may be that recessed expansion chamber 16 may extend extension distance 42 from barrel end 18 to muzzle end 44. Extension distance 42 may be sized and configured to fit various caliber and sizes of the pistol firearm used with gun slide 10 with recessed expansion chamber. In select embodiments, extension distance 42 may be at least 0.1 inches from barrel end 18 to muzzle end 44. In select possibly preferred embodiments, extension distance 42 may be at least 0.23 inches from barrel end 18 to muzzle end 44.

Still referring to FIGS. 11-12 and 24-25, one feature of gun slide 10 with recessed expansion chamber 16 may be that recessed expansion chamber 16 may be recessed from main barrel support 46 recessed depth 48. Recessed depth 48 may be sized and configured to fit various caliber and sizes of the pistol firearm used with gun slide 10 with recessed expansion chamber. In select embodiments, recessed depth 48 may be at least 0.01 inches from main barrel support 46. In select possibly preferred embodiments, recessed depth 48 may be at least 0.04 inches from main barrel support 46.

Still referring to FIGS. 11-12 and 24-25, one feature of gun slide 10 with recessed expansion chamber 16 may be that recessed expansion chamber 16 may include width 50 wider than muzzle opening 52. Width 50 may be sized and configured wider than various muzzle openings to fit various caliber and sizes of the pistol firearm used with gun slide 10 with recessed expansion chamber. In select embodiments, width 50 of recessed expansion chamber 16 may be at least 0.1 inches wider than muzzle opening 52. In select possibly preferred embodiments, width 50 of recessed expansion chamber 16 may be at least 0.32 inches wider than muzzle opening 52.

Still referring to FIGS. 11-12 and 24-25, in select embodiments of gun slide 10 with recessed expansion chamber 16, recessed expansion chamber 16 may extend extension distance 42 from barrel end 18 to muzzle end 44, recessed expansion chamber 16 may be recessed from main barrel support 46 recessed depth 48, and recessed expansion chamber 16 may include width 50 wider than muzzle opening 52. In select embodiments, extension distance 42 may be at least 0.1 inches from barrel end 18 to muzzle end 44, recessed depth 48 may be at least 0.05 inches from main barrel support 46, and width 50 of recessed expansion chamber 16 may be at least 0.1 inches wider than muzzle opening 52. In select possibly preferred embodiments, extension distance 42 may be at least 0.3 inches from barrel end 18 to muzzle end 44, recessed depth 48 may be at least 0.08 inches from main barrel support 46, and width 50 of recessed expansion chamber 16 may be at least 0.32 inches wider than muzzle opening 52.

As best shown in FIGS. 3, 8, 9, 11, 12, 16, 21, 22, 24, and 25, another feature of gun slide 10 with recessed expansion chamber 16 may be that recessed expansion chamber 16 may create splash back wall 54. Splash back wall 54 may be configured to redirect gases 22 away from muzzle end opening 56 and out through expansion chamber openings 20 in recessed expansion chamber 16. In select embodiments, splash back wall 54 may be positioned on muzzle end opening 56. Splash back wall 54 may be created from width 50 of recessed expansion chamber 16 being wider than muzzle opening 52. This change in dimension from the larger recessed expansion chamber 16 to the smaller muzzle opening 52 creates splash back wall 54 at the transition from recessed expansion chamber 16 to muzzle opening 52. This splash back wall 54 may thus create resistance for gases 22 leaving barrel end 18 and flowing outward towards muzzle opening 52. This resistance provided by splash back wall 54 may force more gases 22 through expansion chamber opening 20 in recessed expansion chamber 16, like through top 32 and/or side 28 and/or both sides 30.

Referring now specifically to FIGS. 1 and 14, another feature of gun slide 10 with recessed expansion chamber 16 may be that recessed expansion chamber 16 may be configured for improving recoil mitigation performance 58 of pistol firearm 12. Wherein, recessed expansion chamber 16 may be configured to increase flow 60 of gases 22 out from gun slide 10 through expansion chamber openings 20 in gun slide 10, where the increased flow 60 of gases 22 out through expansion chamber openings 20 from recessed expansion chamber may be configured for improving recoil mitigation performance 58 of pistol firearm 12. Wherein, the improved recoil mitigation of pistol firearm 12 may be configured to improve user control, experience and overall performance of pistol firearm 12.

In another aspect, the instant disclosure embraces the disclosed gun slide 10 with a recessed expansion chamber 16 in any embodiment and/or combination of embodiments shown and/or described herein.

As shown in FIGS. 1 and 14, in another aspect, the instant disclosure embraces pistol firearm 12 with the disclosed gun slide 10 with recessed expansion chamber 16 in any embodiment and/or combination of embodiments shown and/or described herein.

In sum, the disclosed recessed expansion chamber 16 design of gun slide 10 may provide a cylindrical shaped cavity 36 forward of barrel end 18 for gases 22 to immediately expand after exiting barrel 14 at barrel end 18. The disclosed recessed expansion chamber 16 design also creates splash back wall 54 on muzzle end 44 that redirects gases 22 away from muzzle end opening 56 and out through expansion chamber openings 20 from recessed expansion chamber 16. This increased flow 60 of gases 22 out of gun slide 10 through expansion chamber opening 20 from recessed expansion chamber 16 may improve recoil mitigation performance 58. This improved recoil mitigation may lead to improved user control, experience and overall performance.

The disclosed recessed expansion chamber 16 may be a recessed chamber built into gun slide 10 forward of barrel end 18 and barrel support 40 and before muzzle end 44 of gun slide 10. Barrel 14 may sit recessed into gun slide 10 and muzzle end 44 of barrel 14 may sit before recessed expansion chamber 16. This may allow gases 22 leaving barrel 14 to expand inside gun slide 10 and be directed upwards through expansion chamber openings 20, like slot 34 on top 32 of gun slide 10, instead of out the front of gun slide 10 through muzzle end 44. The redirected gases 22 out top 32 of gun slide 10 may work to mitigate muzzle rise during recoil thereby providing reoil mitigation performance 58 of pistol firearm 12.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. A gun slide for a pistol firearm with a barrel, the gun slide comprising:

a recessed expansion chamber, the recessed expansion chamber is positioned forward of a barrel end of the barrel;

an expansion chamber opening being a slot through a top of the gun slide above and in communication with the recessed expansion chamber;

wherein the recessed expansion chamber includes:

a cylindrical shaped cavity positioned forward of the barrel end and sized larger than the barrel, the cylindrical shaped cavity positioned forward of the barrel end and sized larger than the barrel end is configured for the gases to immediately expand after exiting the barrel end of the barrel, wherein the cylindrical shaped cavity is positioned in a body of the gun slide forward of a barrel support;

the cylindrical shaped cavity of the recessed expansion chamber is recessed from a main barrel support to a recessed depth;

the cylindrical shaped cavity of the recessed expansion chamber includes a width, the width of the recessed expansion chamber is wider than a muzzle opening;

the cylindrical shaped cavity of the recessed expansion chamber extends an extension distance from the barrel end to a muzzle end;

the cylindrical shaped cavity of the recessed expansion chamber creates a splash back wall, the splash back wall is configured to redirect the gases away from a muzzle end opening and out through the expansion chamber opening from the recessed expansion chamber, wherein the splash back wall is positioned on the muzzle end opening around the periphery of the muzzle opening; and the cylindrical shaped cavity of the recessed expansion chamber is configured to allow gases leaving the barrel at the barrel end to expand and be directed out of the gun slide through the slot through the top of the gun slide.

2. The gun slide of claim 1, wherein the recessed expansion chamber extends an extension distance from the barrel end to a muzzle end.

3. The gun slide of claim 2, wherein the extension distance is at least 0.1 inches from the barrel end to the muzzle end.

4. The gun slide of claim 3, wherein the extension distance is at least 0.23 inches from the barrel end to the muzzle end.

5. The gun slide of claim 1, wherein the recessed depth is at least 0.01 inches from the main barrel support.

6. The gun slide of claim 5, wherein the recessed depth is at least 0.04 inches from the main barrel support.

7. The gun slide of claim 1, wherein the width of the recessed expansion chamber is at least 0.1 inches wider than the muzzle opening.

8. The gun slide of claim 7, wherein the width of the recessed expansion chamber is at least 0.32 inches wider than the muzzle opening.

9. The gun slide of claim 1, wherein:

the extension distance is at least 0.1 inches from the barrel end to the muzzle end;

the recessed depth is at least 0.05 inches from the main barrel support; and the width of the recessed expansion chamber is at least 0.1 inches wider than the muzzle opening.

10. The gun slide of claim 1, wherein:

the extension distance is at least 0.3 inches from the barrel end to the muzzle end;

the recessed depth is at least 0.08 inches from the main barrel support; and the width of the recessed expansion chamber is at least 0.32 inches wider than the muzzle opening.

11. The gun slide of claim 1, wherein:

the recessed expansion chamber is configured for improving recoil mitigation performance of the pistol firearm;

the recessed expansion chamber is configured to increase flow of the gases out of the gun slide through the expansion chamber opening, where the increased flow of the gases out through the expansion chamber opening from the recessed expansion chamber are configured for the improving recoil mitigation performance of the pistol firearm; and the improved recoil mitigation performance of the pistol firearm is configured to improve user control, experience and overall performance of the pistol firearm.

12. A gun slide for a pistol firearm with a barrel, the gun slide comprising:

a recessed expansion chamber, the recessed expansion chamber is positioned forward of a barrel end of the barrel;

an expansion chamber opening through the gun slide in communication with the recessed expansion chamber, the expansion chamber opening is a slot through the top of the gun slide above the recessed expansion chamber, wherein the recessed expansion chamber is configured to allow gases leaving the barrel at the barrel end to expand and be directed out of the gun slide through the slot on the top of the gun slide;

the recessed expansion chamber is configured to allow the gases leaving the barrel at the barrel end to expand and be directed out of the gun slide through the expansion chamber opening;

the recessed expansion chamber includes a cylindrical shaped cavity positioned forward of the barrel end and sized larger than the barrel, the cylindrical shaped cavity positioned forward of the barrel end and sized larger than the barrel end is configured for the gases to immediately expand after exiting the barrel end of the barrel, the cylindrical shaped cavity is positioned in a body of the gun slide forward of a barrel support;

the recessed expansion chamber extends an extension distance from the barrel end to a muzzle end, the extension distance is at least 0.3 inches from the barrel end to the muzzle end;

the recessed expansion chamber is recessed from a main barrel support to a recessed depth, the recessed depth is at least 0.08 inches from the main barrel support;

the recessed expansion chamber including a width, the width of the recessed expansion chamber is wider than a muzzle opening, the width of the recessed expansion chamber is at least 0.32 inches wider than the muzzle opening;

the recessed expansion chamber creates a splash back wall, the splash back wall is configured to redirect the gases away from a muzzle end opening and out through the expansion chamber opening from the recessed expansion chamber, wherein the splash back wall is positioned on the muzzle end opening around the periphery of the muzzle opening;

wherein:

the recessed expansion chamber is configured for improving recoil mitigation performance of the pistol firearm;

the recessed expansion chamber is configured to increase flow of the gases out from the gun slide through the expansion chamber opening, where the increased flow of the gases out through the expansion chamber opening from the recessed expansion chamber are configured for the improving recoil mitigation performance of the pistol firearm; and the improving recoil mitigation performance of the pistol firearm is configured to improve user control, experience and overall performance of the pistol firearm.

13. A pistol firearm comprising:

a gun slide comprising:

a recessed expansion chamber, the recessed expansion chamber is positioned forward of a barrel end of the barrel;

an expansion chamber opening being a slot through a top of the gun slide above and in communication with the recessed expansion chamber;

wherein the recessed expansion chamber includes:

a cylindrical shaped cavity positioned forward of the barrel end and sized larger than the barrel, the cylindrical shaped cavity positioned forward of the barrel end and sized larger than the barrel end is configured for the gases to immediately expand after exiting the barrel end of the barrel, wherein the cylindrical shaped cavity is positioned in a body of the gun slide forward of a barrel support;

the cylindrical shaped cavity of the recessed expansion chamber is recessed from a main barrel support to a recessed depth;

the cylindrical shaped cavity of the recessed expansion chamber includes a width, the width of the recessed expansion chamber is wider than a muzzle opening;

the cylindrical shaped cavity of the recessed expansion chamber extends an extension distance from the barrel end to a muzzle end;

the cylindrical shaped cavity of the recessed expansion chamber creates a splash back wall, the splash back wall is configured to redirect the gases away from a muzzle end opening and out through the expansion chamber opening from the recessed expansion chamber, wherein the splash back wall is positioned on the muzzle end opening around the periphery of the muzzle opening; and the cylindrical shaped cavity of the recessed expansion chamber is configured to allow gases leaving the barrel at the barrel end to expand and be directed out of the gun slide through the slot through the top of the gun slide.

* * * * *